US005203596A

United States Patent [19]

Stevens

[11] Patent Number: 5,203,596

[45] Date of Patent: Apr. 20, 1993

[54] LOCK ASSEMBLY FOR A SLIDING WINDOW, OR THE LIKE

[76] Inventor: Larry Stevens, 1400 E. Palm Canyon,, Palm Springs, Calif. 92264

[21] Appl. No.: 956,689

[22] Filed: Oct. 1, 1992

[51] Int. Cl.[5] ..... E05C 3/04

[52] U.S. Cl. ..... 292/204; 292/DIG. 46

[58] Field of Search ..... 292/103, 136, 204, DIG. 46, 292/DIG. 47, 101, 95, 202, 194

[56] References Cited

U.S. PATENT DOCUMENTS

| | | | |
|---|---|---|---|
| 1,347,048 | 7/1920 | Mardaus | 292/103 |
| 1,755,454 | 4/1930 | Nelson | 292/103 X |
| 2,699,204 | 1/1955 | Davis | 292/DIG. 46 X |
| 2,701,157 | 2/1955 | LeBon, III | 292/DIG. 46 X |
| 4,160,560 | 7/1979 | Hauber | 292/DIG. 46 X |

*Primary Examiner*—Richard E. Moore

[57] ABSTRACT

A lock assembly for a sliding panel-type window which is intended to be mounted on the end of the sliding panel component of the window, and which includes a pivotally mounted lever with a bent over extremity, and which may be turned manually when the window is closed to cause the extremity of the lever to be received in a hole of the frame of the window. The lever serves to lock the sliding panel in a closed, or partially opened position, and it also serves to prevent the panel from being lifted up and out of the track in which it slides.

5 Claims, 1 Drawing Sheet

FIG. 1
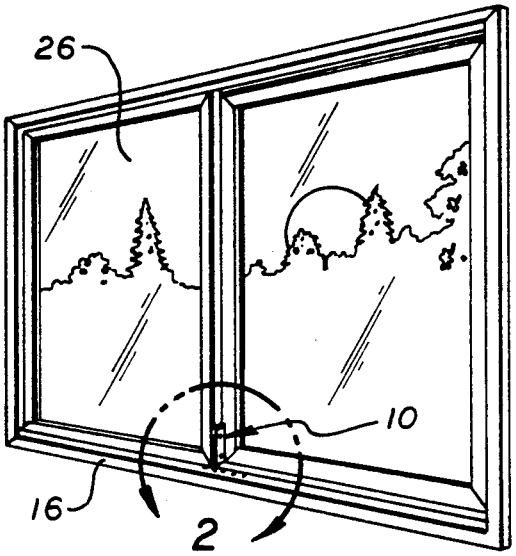
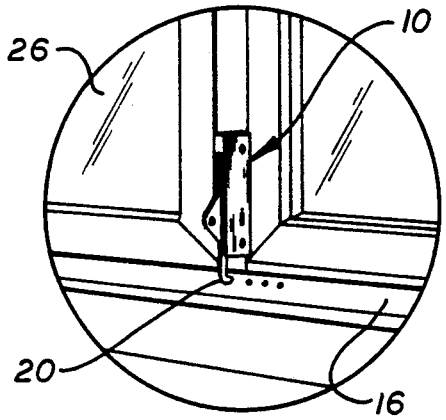
FIG. 2
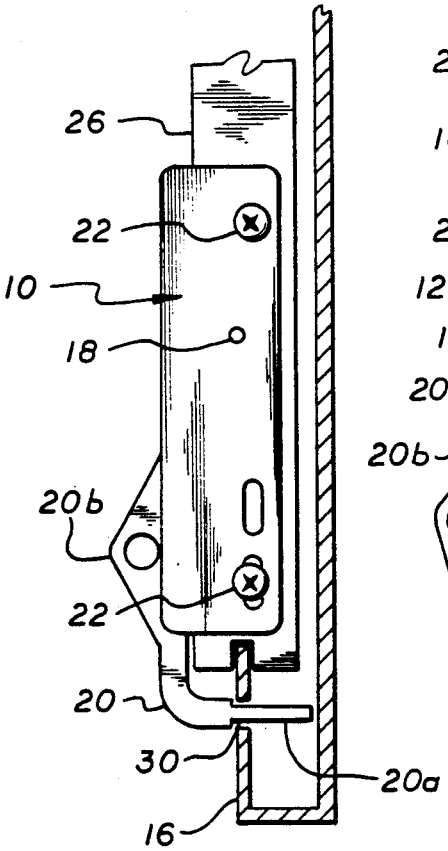
FIG. 3
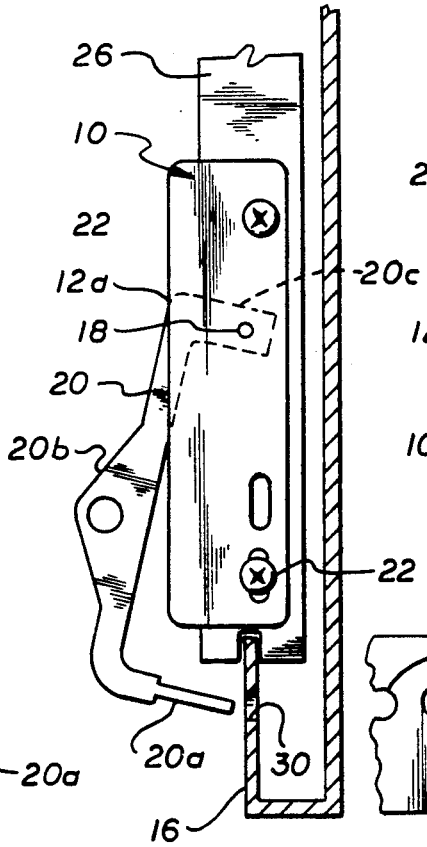
FIG. 4
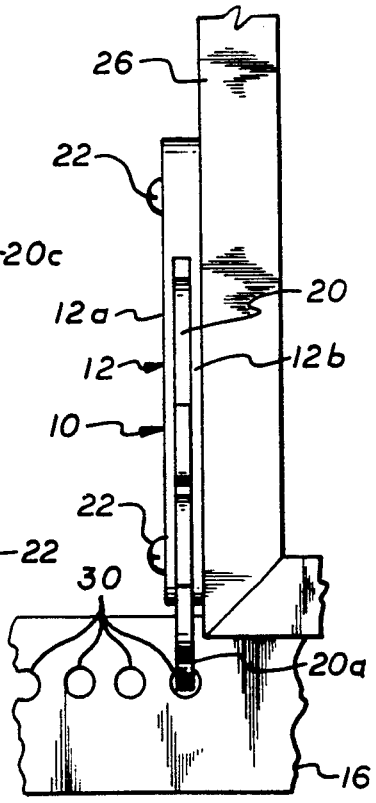
FIG. 5

LOCK ASSEMBLY FOR A SLIDING WINDOW, OR THE LIKE

BACKGROUND OF THE INVENTION

The present invention provides a lock assembly for a sliding panel-type window which is intended to be mounted on the rear-end of the sliding panel. The lock assembly includes a pivotally mounted lever with a bent-over extremity. The lever may be turned manually when the window is closed to cause the extremity to be received in a hole in the frame of the window. The lever serves to lock the window in a completely closed position, and in a series of partially open positions, and it also serves to prevent the panel from being lifted up and out of the track in which it slides.

It is usual in the prior art for sliding panel windows to be locked by means of a spring-loaded latch such as described, for example, in U.S. Pat. No. 3,881,759. However, even though such latches may serve to hold the windows locked against sliding motion, the sliding panels can still be removed from their frames by intruders, by moving the sliding panels upwardly and out of their tracks. The simple lock assembly of the present invention positively locks the window, and it also serves to prevent the sliding panel from being lifted up and out of its track.

Accordingly, a general objective of the present invention is to provide a dead bolt type of tamper-proof lock for a sliding panel window which serves to hold the sliding panel in its track and which restrains the panel from any vertical or horizontal movement, thereby to provide positive protection against illegal entry.

Another objective of the invention is to provide such a lock assembly which is easy to install, and one which may be mounted on virtually all existing horizontal or vertical sliding panel or doors.

Yet another objective of the invention is to provide such a lock assembly which is easy to operate between a position in which a sliding panel is free to move back and forth in its track and a position in which the panel is securely locked and restrained in its frame.

A feature of the lock assembly of the invention is that it may be installed not only to secure the sliding panel in a closed position, but also to secure the panel in one or more partially open positions for ventilation without loss of security.

Another feature of the lock assembly of the invention is that it is absolutely safe, and can be opened quickly and easily in case of fire or other emergency for rapid exit.

BRIEF DESCRIPTION OF THE DRAWING

FIG. 1 is a perspective representation of a sliding panel type of window, and showing the lock assembly of the invention mounted at one end of a sliding panel which forms a part of the window;

FIG. 2 is an enlarged view of a portion of the window of FIG. 1, showing the manner in which the lock assembly of the invention is mounted on one end of the sliding panel;

FIG. 3 is a side elevational view of the lock assembly, showing the lock in a closed position;

FIG. 4 is a side elevation of the lock assembly, like FIG. 3, but showing the lock in an open position; and FIG. 5 is an end view of the lock assembly of FIG. 3.

DETAILED DESCRIPTION OF THE ILLUSTRATED EMBODIMENT

As shown in FIGS. 1 and 2 of the drawings, the lock assembly 10 of the invention is mounted on the inner end of a sliding window panel 26. The sliding panel may be moved horizontally back and forth in tracks formed by the window frame 16.

As shown in FIGS. 3, 4 and 5, the lock assembly 10 of the invention includes a housing 12 which may be formed of a pair of sections **12*a* and 12*b*, which are held together by a rivet 18 such as rivet 18. Rivet 18 serves as a pivot pin for a lever 20 which is sandwiched between the sections 12*a* and 12*b* of housing 12. Rivet 18 passes through a hole in bent-over end 20*c* of lever 20. The lever is held sufficiently tightly between the sections 12*a* and 12*b* in a frictional engagement, so that it may be turned to any desired angular position and frictionally held in that position by the housing. The housing itself may be mounted on the inner end of the sliding window panel 26 by means of screws of 22 which extend through appropriate holes in the housing 12**.

The lever 20 has a bent-over end portion **20*a* which extends at 90 to the intermediate portion of the lever. A handle 20*b* is formed integral with the lever at an intermediate position. The handle 20*b* may be grasped by hand, or by an appropriate tool, to turn the lever 20 either to its locked position of FIG. 3 or to its unlocked position of FIG. 4. When the lever is in its locked position, the end 20*a* is received in any one of a series of holes 30 formed in frame 16 (FIG. 5**) so that the sliding panel may be locked in a fully closed position, or in any selected partially opened position.

The lock assembly of the invention is simple to operate. When the window is to be locked, lever 20 is merely turned so that its end portion **20*a* enters one of the holes 30 to cause the lever to act as a dead-bolt, thereby preventing the window panel from being moved in any direction with respect to the frame. To open the window, lever 20** is merely turned so that its end portion is withdrawn from the hole and the panel can then be easily moved back and forth in its tracks.

The invention provides, therefore, a simple and inexpensive lock assembly which is easy to install, and easy to operate. The lock assembly of the invention, when in its locked position, provides a dead bolt type of tamper-proof lock for a sliding window or door, and it serves to hold the window or door in its track and restrains it from any vertical or horizontal thereby providing positive protection against illegal entry.

It will be appreciated that while a particular embodiment of the invention has been shown and described, modifications may be made. It is intended in the claims to cover all such modifications which come within the true spirit and scope of the invention.

I claim:

1. In combination a window, which has at least one sliding panel with an inner end and an outer end, and which also has a frame forming a lower track in which the sliding panel may be moved back and forth, said frame having at least one hole therein adjacent to said lower track, said panel being removable from said frame by moving said panel upwardly and out of said track, and a lock assembly for preventing said panel from being moved back and fourth in said frame and for preventing said panel from being moved upwardly out of said track, said lock assembly including: a housing; means for mounted said housing on the inner end of said sliding panel; a lever member pivotally mounted in said housing having an elongated intermediate section extending beyond the confines of the housing and a further having a bent-over end section to be received in said hole in said frame when said panel is moved along said track to a predetermined position in said frame, said lever member being moved angularly between a first position in which said first end section is displaced from said frame and a second position in which said first end section of said lever is received in said hole in the frame to prevent the panel from being moved back and forth in said frame or upwardly out of said track.

2. The combination defined in claim 1, in which said frame has a series of holes therein, and said first end section of said lever may be received in any one of said series of holes in said frame when said panel is moved along said track to any one of a series of corresponding positions in said frame to lock said panel in said frame at each of said corresponding positions against back and forth movement in said frame and against upward movement out of said track.

3. The combination defined in claim 1, in which said housing comprises a pair of like planar sections, and said lock assembly includes means for holding said sections together in spaced and parallel relationship with said lever member sandwiched therebetween in a friction fit with said planar sections so that the lever member may be maintained at any angular position to which it may be moved.

4. The combination defined in claim 1, in which said lever member has a second bent-over end section having its distal end pivotally mounted at one end of said housing.

5. The combination defined in claim 1, in which said lever means has a handle integral with said elongated intermediate section of said lever member and extending outwardly therefrom to permit said lever member to be turned to said first position and said second position.

* * * * *